US007510491B2

(12) United States Patent
Lortscher

(10) Patent No.: US 7,510,491 B2
(45) **Date of Patent: *Mar. 31, 2009**

(54) BASEBALL SWING TRAINING AID

(76) Inventor: Lane Lortscher, 18037 Martha St., Encino, CA (US) 91316

( * ) Notice: Subject to any disclaimer, the term of this patent is extended or adjusted under 35 U.S.C. 154(b) by 0 days.

This patent is subject to a terminal disclaimer.

(21) Appl. No.: 11/428,931

(22) Filed: Jul. 6, 2006

(65) Prior Publication Data

US 2007/0167262 A1 Jul. 19, 2007

Related U.S. Application Data

(63) Continuation-in-part of application No. 11/306,984, filed on Jan. 18, 2006.

(51) Int. Cl.
*A63B 69/40* (2006.01)
*A63B 69/00* (2006.01)

(52) U.S. Cl. ..... 473/417; 473/422; 473/458

(58) Field of Classification Search ..... 473/417, 473/422, 431, 451, 387; 124/16, 17, 37
See application file for complete search history.

(56) References Cited

U.S. PATENT DOCUMENTS

| | | | | |
|---|---|---|---|---|
| 3,952,477 | A * | 4/1976 | Candor et al. | 53/452 |
| 4,176,838 | A | 12/1979 | Griffin | |
| 5,672,124 | A | 9/1997 | Pecoraro et al. | |
| 6,106,416 | A * | 8/2000 | Ward | 473/465 |
| 6,296,581 | B1 * | 10/2001 | Sever | 473/422 |
| 6,328,665 | B1 * | 12/2001 | Gormley | 473/423 |
| 6,413,175 | B1 | 7/2002 | Mooney, Jr. | |
| 6,682,445 | B1 | 1/2004 | Tanner | |
| D509,551 | S * | 9/2005 | Reynolds | D21/715 |
| 7,226,372 | B2 * | 6/2007 | Flanigan | 473/417 |
| 7,255,658 | B1 * | 8/2007 | VanKuiken et al. | 473/454 |

* cited by examiner

*Primary Examiner*—Mitra Aryanpour
(74) *Attorney, Agent, or Firm*—Kelly Lowry & Kelley, LLP

(57) ABSTRACT

A baseball bat swing training aid includes a housing configured for storing a plurality of balls therein. A ball positioning mechanism is disposed within the housing and includes an arm selectively extendable out of the housing. A ball holder is disposed on an end of the arm. The baseball bat swing training aid further includes a mechanism for removably yet securely fixing the ball positioning mechanism within the housing.

3 Claims, 5 Drawing Sheets

BASEBALL SWING TRAINING AID

BACKGROUND OF THE INVENTION

The present invention generally relates to a device for aiding in the batting of a ball. More particularly, the present invention resides in a baseball bat swing training aid.

Devices for aiding in the training of a batting swing are generally known in the art. For example, U.S. Pat. No. 4,176,838 discloses a batting baseball tee. However, the disclosed tee is not collapsible for easy portability or storage of the tee. In another example, U.S. Pat. No. 5,672,124 discloses an automatic batting tee apparatus. However, the disclosed tee is not able to store balls within its housing. In a further example, U.S. Pat. No. 6,413,175 discloses a batting tee. However, the disclosed tee is bulky and not able to store balls. In yet another example, U.S. Pat. No. 6,682,445 discloses a durable batting tee. However, while the disclosed tee is collapsible, the tee is not capable of storing a number of balls.

Accordingly, there is a need for a baseball bat swing training aid that is not only collapsible, but able to store balls for use. There is a further need for a swing training aid that is not only portable, but also compact for storage. There is an additional need for a training aid that is easily movable between storage and use configurations, and that relies on minimal support for maintaining an upright configuration. There is a further need for a swing training aid that is economical and easy to manufacture. The present invention fulfills these needs and provides other related advantages.

SUMMARY OF THE INVENTION

The present invention resides in a baseball bat swing training aid assembly that is easily movable between storage and use configurations, providing a baseball bat swing training aid assembly that is not only collapsible and portable, but also able to store balls yet in a manner that is still compact for storage. The baseball bat swing training aid assembly has a simplified structure for maintaining the swing training aid in an upright configuration.

The present invention discloses a baseball bat swing training aid including a housing configured for storing a plurality of balls therein. A ball positioning mechanism is disposed within the housing and includes an arm selectively extendable out of the housing. A ball holder is disposed on an end of the arm. The baseball bat swing training aid further includes a mechanism for removably yet securely fixing the ball positioning mechanism within the housing.

The fixing mechanism holds the ball positioning mechanism within the housing without direct attachment thereto. The fixing mechanism comprises an upper support connected to an upper portion of the ball positioning mechanism for engaging an interior sidewall of the housing and a lower support connected to a lower portion of the ball positioning mechanism for engaging the interior sidewall of the housing. Each support further comprises a resilient wire frame which is pivotable between storage and use positions. Thus, the upper and lower supports fix the ball positioning mechanism within the housing without direct attachment thereto.

The ball positioning mechanism comprises a telescoping extension selectively movable between a retracted position and an extended position. The training aid includes a lock for securing the telescoping extension at or between the retracted and extended positions.

The housing includes a handle and an open end which permits access to an inner cavity of the housing. A lid covers the open end of the housing. The balls are individually removable from the housing through the open end.

Other features and advantages of the present invention will become apparent from the following more detailed description, taken in conjunction with the accompanying drawings which, by way of example, illustrate the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
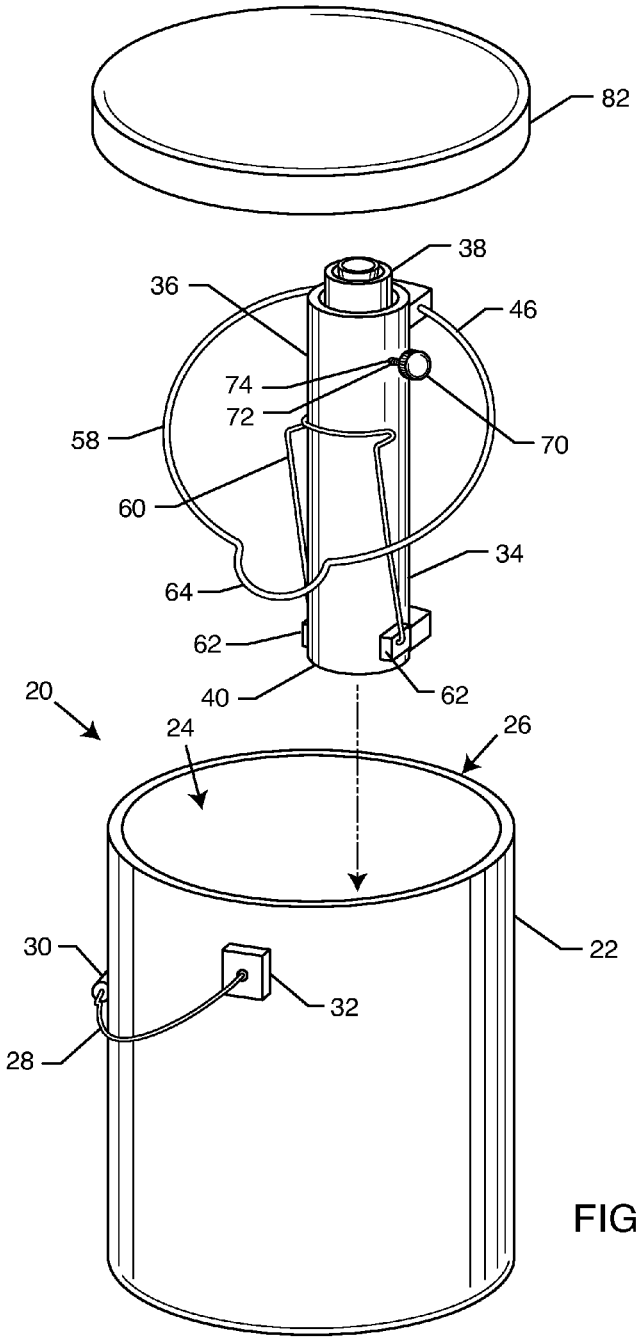
FIG. 1 is a perspective view of a baseball bat swing training aid embodying the present invention, shown in a collapsed, storage configuration.
Figure 2:
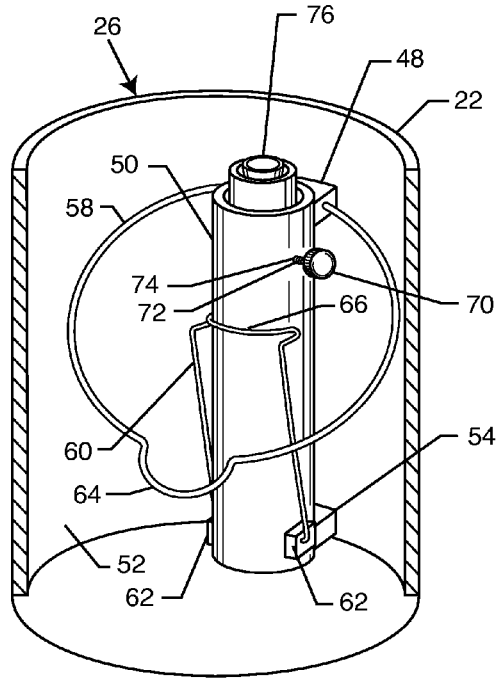
FIG. 2 is a perspective, cross-sectional view of the training aid of FIG. 1 shown with a lid removed to reveal an interior of a housing.
Figure 3:
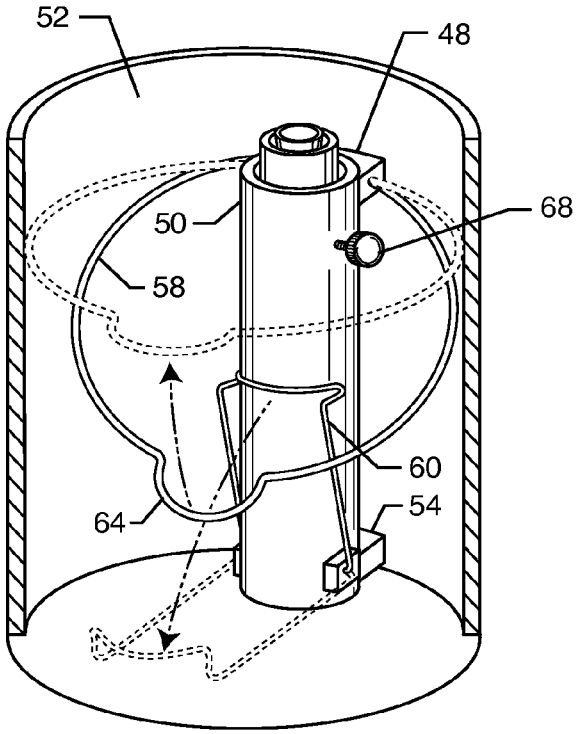
FIG. 3 is a perspective view of the training aid of FIG. 1 shown with a ball positioning mechanism, in a retracted position, within in the interior of the housing and a mechanism for fixing the ball positioning mechanism within the housing in a folded storage position being moved to a use position.
Figure 4:
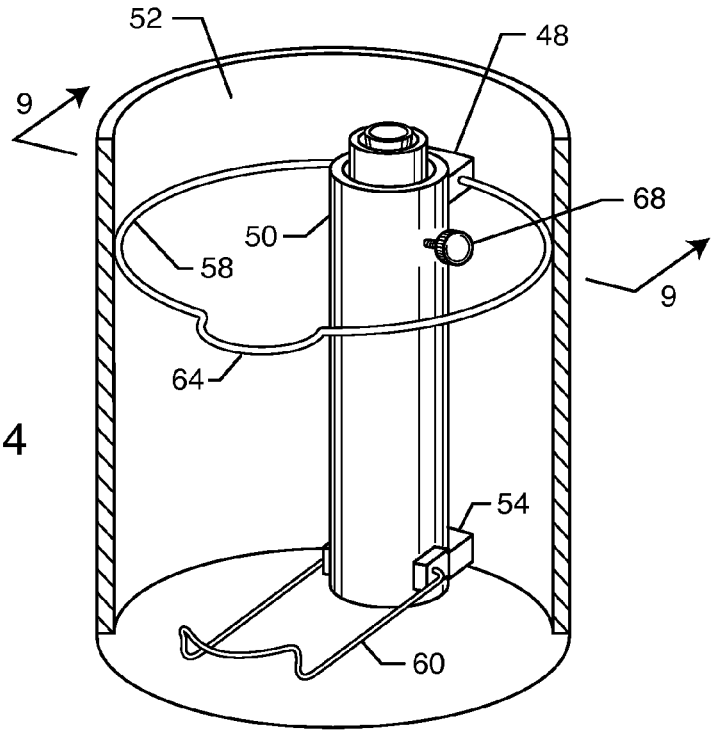
FIG. 4 is a cross-sectional, perspective view of the training aid of FIG. 1 shown with the mechanism for fixing the ball positioning mechanism within the housing in a use position.
Figure 5:
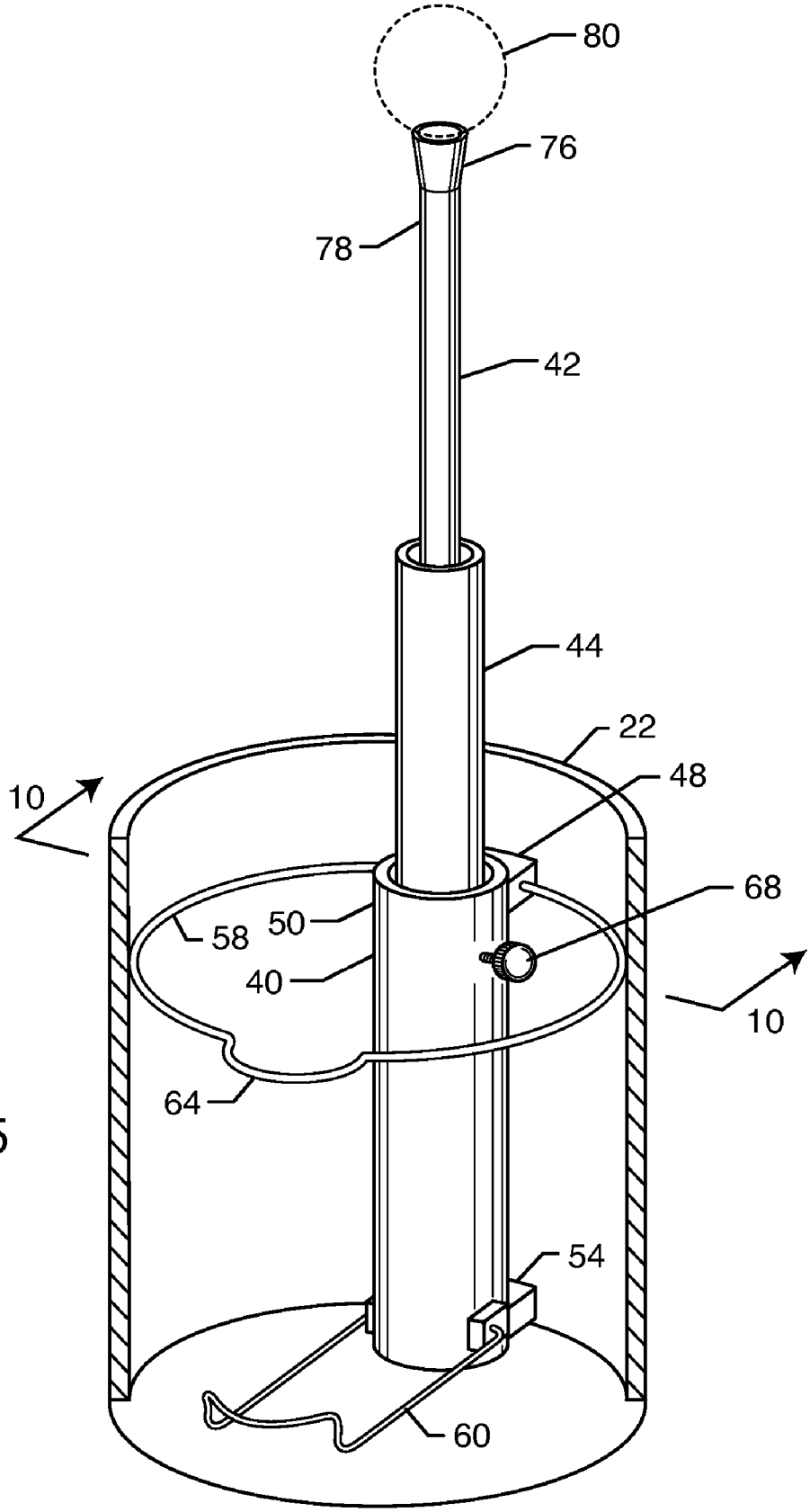
FIG. 5 is a cross-sectional, perspective view of the training aid of FIG. 1 revealing the interior of the housing and the ball positioning mechanism shown in an extended position.
Figure 6:
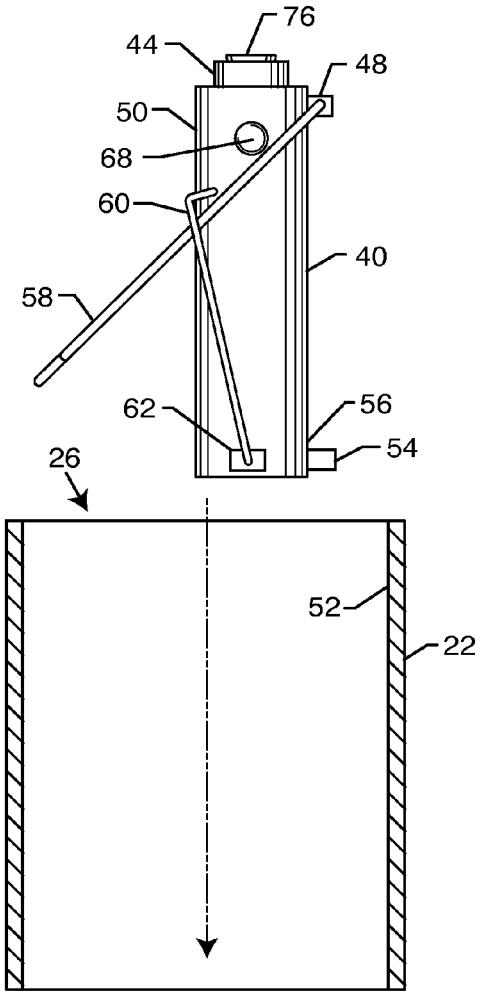
FIG. 6 is a cross-sectional, elevation view of the training aid of FIG. 1.
Figure 7:
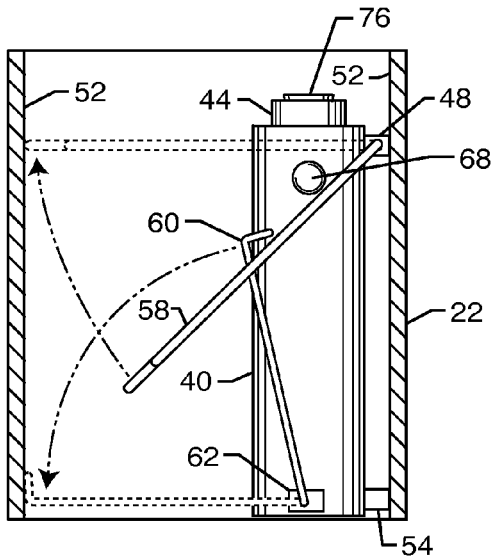
FIG. 7 is a cross-sectional, elevation view of the training aid of FIG. 3.
Figure 8:
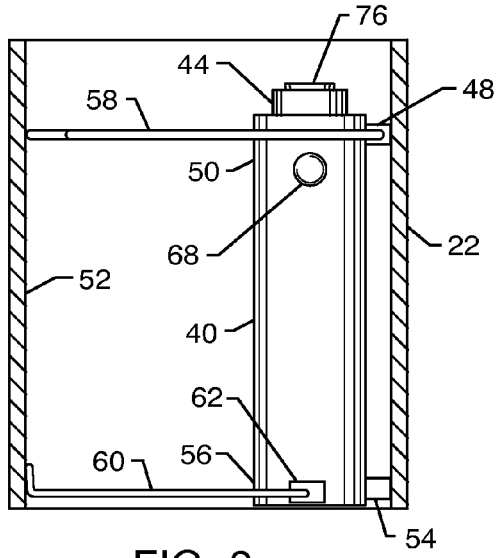
FIG. 8 is a cross-sectional, elevation view of the training aid of FIG. 4.
Figure 9:
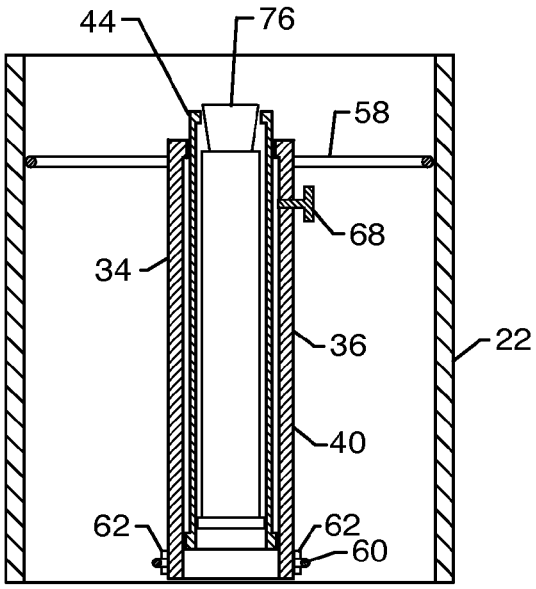
FIG. 9 is a cross-sectional, elevation view of the training aid taken along line 9-9 of FIG. 4.
Figure 10:
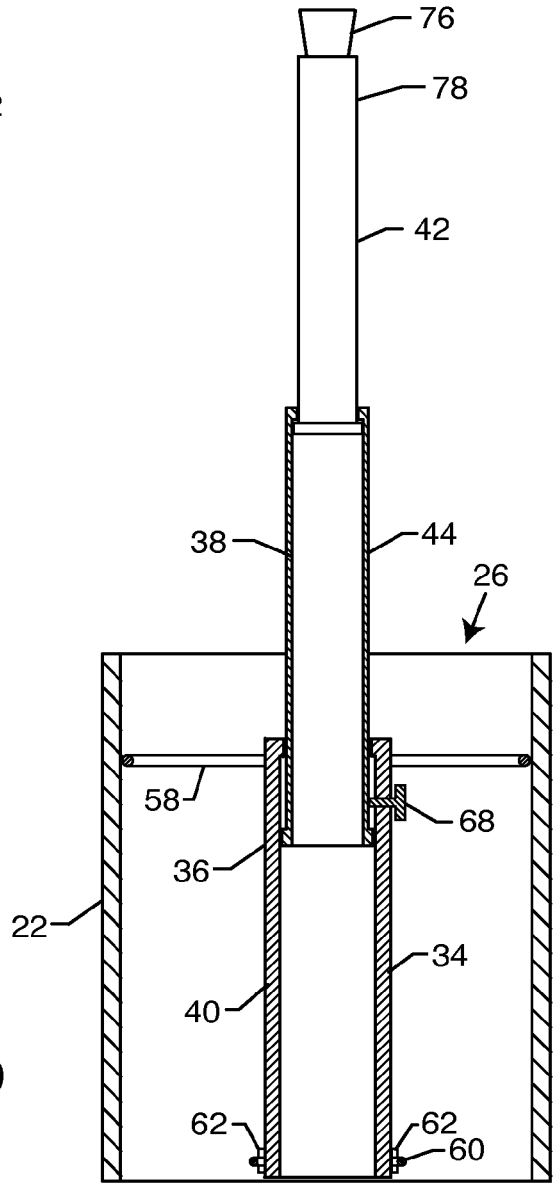
FIG. 10 is a cross-sectional, elevation view of the training aid taken along line 10-10 of FIG. 5.

As shown in the drawings for purposes of illustration, the present invention discloses a portable, collapsible baseball bat swing training aid 20 as seen in FIGS. 1-10. The baseball bat swing training aid 20 includes a housing 22 having an inner cavity 24 for storing a plurality of balls (not shown for clarity), in the form of baseballs, therein. The housing 22 also includes an open end 26 which permits access to the inner cavity 24. The balls are individually removable from the housing 22 through the open end 26. Other balls that may be used include softballs, tennis balls, wiffle balls or the like.

The housing 22 further includes a pivotal handle 28 connected to an exterior surface of the housing 22. The handle 28 is pivotally connected to the housing 22 such that the handle 28 can pivot relative to the housing 22 over the open end 26 of the housing 22. The handle 28 comes in various forms including, but not limited to, a wire handle with a grip section 30 (shown in FIG. 1) that is similar, if not identical to, the kind of handle commonly found on conventional paint cans. The housing 22 includes a pair of attachment members 32 (only one of which is seen in FIG. 1). Each end of the handle 28 extends into a respective attachment member 32, where the end of the handle 28 is held in place, to make the pivotal connection between the handle 28 and the housing 22, in a manner similar, if not identical to, the way handles are pivotally connected to conventional paint cans.

A ball positioning mechanism 34 is in the form of a tube assembly 36 disposed within the inner cavity 24 of the housing 22. The tube assembly 36 is extendable between retracted and extended positions. The tube assembly 36 may be stored within the inner cavity 24 of the housing 22 when not in use. The tube assembly 36 includes a telescoping extension section 38 including a lower tube portion 40, an upper tube portion 42 and an intermediate tube portion 44 disposed therebetween. The tube portions 40, 42, 44 serve as an arm of the ball positioning mechanism 34 that is selectively extendable out of the housing 22. The extension section 38 allows the tube assembly 36 to be selectively movable between at least a completely retracted position and a fully extended position. The telescoping extension 38 also allows the tube assembly 36 to be selectively movable to a position intermediate the retracted and extended positions. The upper tube portion 42 is slidably receivable within the intermediate tube portion 44. Likewise, the intermediate tube portion 44 is slidably receivable within the lower tube portion 40.

The training aid further 20 further includes a mechanism 46 for removably yet securely fixing the ball positioning mechanism 34 within the housing 22. The fixing mechanism 46 holds the ball positioning mechanism 34 within the housing 22 without direct attachment thereto. The fixing mechanism 46 comprises an upper support 48 connected to an upper portion of the lower tube portion 40 that engages an interior sidewall 52 of the housing 22 and a lower support 54 connected to a lower portion 56 of the lower tube portion 40 for engaging the interior sidewall 52 of the housing 22. An upper resilient wire frame 58 is pivotally connected to the upper support 48. A lower resilient wire frame 60 is connected a pair of attachment members 62 on opposite sides of the lower tube portion 40. Each end of the lower wire frame 60 extends into a respective attachment member 62, where the ends of the lower wire frame are held in place. Each wire frame 58, 60 is pivotable between storage and use positions. In the use positions, each wire frame 58, 60 engages the interior sidewall 52 of the housing. Each wire frame 58, 60 may be sized and shaped so as to engage the entire interior circumference of the housing 22 if the housing 22 is generally cylindrical or the frames 58, 60 may be sized and shaped to engage the interior sidewall 52 of the housing 22 at a position generally opposite from the position on the interior sidewall where the upper and lower supports 48, 54 engage the sidewall 52. The upper wire frame 58, generally circular in shape with a smaller outer circumference than the circumference of the interior sidewall 52, has a bulbous extension 64 designed to abuttingly, press-fit engage the interior sidewall 52 of the housing. Engagement of the bulbous extension 64 with the sidewall 52 causes the remaining portion of the resilient wire frame 58 to deform towards an ovoid shape that engages other portions of the sidewall 52 and otherwise presses the upper support 48 against the sidewall 52. The lower wire frame 60, generally rectangular in shape, has an extension 66 designed to abuttingly, press-fit engage the interior sidewall 52 of the housing. Engagement of the bulbous extension 66 with the sidewall 52 presses the lower support 54 against the sidewall 52. Thus, the upper and lower supports 48, 54 and the wire frames 58, 60 cooperate to fix the ball positioning mechanism 34 within the housing 22 without direct attachment thereto.

The training aid 20 includes a lock or locking mechanism 68 for securing the telescoping extension 38 at or between the retracted and extended positions. The locking mechanism 68 holds and/or releases the intermediate tube portion 44 to move relative to the lower tube portion 40, between retracted and extended positions. The upper and intermediate tube portions 42, 44 are held in position relative to each other by press-fit engagement. Alternatively, a locking mechanism (not shown), similar to locking mechanism 68 described above and below, may be used to hold and/or release the upper tube portion 42 to move relative to the intermediate tube portion 44, between retracted and extended positions. In this manner, the intermediate tube portion 44 may be moved between retracted and extended positions relative to the lower tube portion 40 and the upper tube portion 42 may be moved between retracted and extended positions relative to the intermediate tube portion 44 and/or the lower tube portion 40.

The locking mechanism 68 uses a turnable knob 70 connected to a threaded shank 72 that extends through a threaded bore 74 in the lower tube portion 40 (and a threaded bore in the intermediate tube portion 44, if desired). An end of the threaded shank 72 of the locking mechanism 68 abuts against the intermediate tube portion 44 when the knob 70 is turned in one direction to lock the intermediate tube portion 44 in place relative to the lower tube portion 40. Turning the knob 70 in the other direction releases the intermediate tube portion 44 to telescopically move relative to the lower tube portion 40. In another alternative, each locking mechanism could include a cylindrical post connected to a bent flexible member located within the tube portions 42, 44. Each post, respectively, extends through an aperture on a side of the upper and intermediate tube portions 42, 44. The post extends through an aperture(s) located at a fixed point(s) on the tube portion 44, 40. If the tube assembly 36 is in the extended position, a user can retract the retracted position by depressing the post extending through the aperture on the tube portion 44, 40. Once the post enters the tube portion 44, 40, the interior surface of the respective tube portion 44, 40 maintains the post in a depressed position. However, once the post becomes coaxial with one of the apertures of the tube portion 44, 40, the force of the flexible member pushes the post through the aperture the post is aligned with, locking the tube assembly 36 in position. If the user desires to move the tube assembly 36 into a fully retracted position within the housing 22, the user can depresses the post(s), disengaging the lock(s), and push the tube portions 42, 44 towards the housing 22 until the tube portions 42, 44 can go no further.

A ball holder 76 is disposed on an end 78 of the upper tube portion 42 of the extension section 38 of the tube assembly 36. A ball 80 is shown on top of the ball holder 76 in FIG. 5. The ball holder 76 may come in various forms including, but not limited to, a cylindrical tube having an inverted conical end formed with or connected to the end 78 of the upper tube portion 42, an inverted conical helical spring connected to the end 72 of the upper tube portion 42 or the like. The ball holder 76 is disposed within the inner cavity 24 of the housing 22 in the storage configuration.

The baseball bat swing training aid 20 includes a lid 82 covering the open end 26 of the housing 22 and limits access to the inner cavity 24 of the housing 22. The lid 82 may include an aperture through which the extension section 38 of the tube assembly 36 is movable between the extended and retracted positions. If the lid 82 includes an aperture, the ball holder 76 may be disposed above the lid 82 when the telescoping extension 38 is in the retracted position. The diameter of the aperture should be larger than the exterior diameter of the intermediate portion 44 of the extension section 36 and/or the exterior diameter of the ball holder 76 so that the ball positioning mechanism 34 can be used even with the lid 82 covering the open end 26 of the housing 22. The aperture also allows the lid 82 to be lifted off the housing 22 without interference from the tube assembly 36 or the ball holder 76.

The weight of the balls filling the inner cavity 24 of the housing 22 is sufficient to prevent the housing 22 from tipping over during use and/or the base of the housing 22 may be sufficiently weighted so as to prevent the baseball bat swing training aid 20 from tipping over when in use. In an alternative, the housing 22 may include a sharp, pointed stake extending from the bottom of the base of the housing 22 in order to secure the baseball bat swing training aid 20 to the ground during use by driving the stake into the ground deep enough to prevent the housing 22 from tipping over during use.

Alternatively, the ball holder 76 may be resiliently connected to the end 78 of the upper tube portion 42 of the tube assembly 36 by a flexible cord that comes in various forms including, without limitation, a bungee cord or the like. A first knotted end of the cord is held within a lower compartment of the end 78 of the upper tube portion 42 by a dividing wall between the lower compartment and an upper compartment of the end 78 of the upper tube portion 42. The cord extends through an aperture in the dividing wall, with the smaller diameter of the aperture preventing the larger diameter of the first knotted end from passing into the upper compartment. A second knotted end of the cord is held within an upper compartment of the ball holder 76 by a dividing wall between the upper compartment and a lower compartment of the ball holder 76. The cord extends through an aperture in the dividing wall, with the smaller diameter of the aperture preventing the larger diameter of the second knotted end from passing into the lower compartment. The flexible cord allows the ball holder 76 to bend/pivot with respect to the upper tube portion 42. A lower end of the ball holder 76 includes an annular ring and a cylindrical guide that extends into the upper compartment of the upper tube portion 42 in the use configuration. In the use configuration, the annular ring abuts against the end 78 of the upper tube portion 42 and prevents the ball holder 76 from further movement into the upper compartment of the upper tube portion 42. The ball holder 76 may be disposed within the housing 22 in the storage configuration, with the ball holder 76 bent/pivoted with respect to the upper tube portion 42. The resilience/flexibility of the cord allows the ball holder 76 to automatically pivot from the storage to the use configuration, where the ball holder 76 is aligned with the upper tube portion 42, with the cord literally pulling the ball holder 76 and upper tube portion 42 into alignment.

While the baseball bat swing training aid 20 has been described in the context of baseball, the training aid 20 is equally applicable in the context of softball, wiffle ball or the like.

The above-described embodiment of the present invention is illustrative only and not limiting. It will thus be apparent to those skilled in the art that various changes and modifications may be made without departing from this invention in its broader aspects.

What is claimed is:

1. A baseball bat swing training aid, comprising:

a housing configured for storing a plurality of balls therein;

a ball positioning mechanism disposed within the housing, including a telescoping extension having an arm selectively extendable out of the housing, wherein the telescoping extension is selectively movable between a retracted position and an extended position;

a ball holder disposed on an end of the arm; and a fixing mechanism pivotally connected to the ball positioning mechanism for engaging an interior sidewall of the housing to removably yet securely fix the ball positioning mechanism within the housing without direct attachment thereto, wherein the fixing mechanism comprises an upper support connected to an upper portion of the ball positioning mechanism for engaging the interior sidewall of the housing and a lower support connected to a lower portion of the ball positioning mechanism for engaging the interior sidewall of the housing, and wherein the upper and lower supports each comprise a resilient wire frame pivotable between storage and use positions.

2. The training aid of claim 1, including a lock for securing the telescoping extension at or between the retracted and extended positions.

3. The training aid of claim 1, wherein the housing includes an open end permitting access to an inner cavity thereof, a lid for covering the open end, and a handle, wherein the balls are individually removable from the housing through the open end.

* * * * *